United States Patent [19]

Nestor et al.

[11] Patent Number: 4,892,488

[45] Date of Patent: Jan. 9, 1990

[54] IGNITION CABLE TERMINATION ASSEMBLY AND METHOD OF MAKING SAME

[75] Inventors: Charles R. Nestor, Niles; John A. Yurtin, Southington, both of Ohio

[73] Assignee: General Motors Corporation, Detroit, Mich.

[21] Appl. No.: 117,050

[22] Filed: Nov. 5, 1987

[51] Int. Cl.[4] ..... H01R 4/24; H01R 11/20

[52] U.S. Cl. ..... 439/438; 439/853; 439/441

[58] Field of Search ..... 439/438, 439, 441, 472, 439/738

[56] References Cited

U.S. PATENT DOCUMENTS

| | | | |
|---|---|---|---|
| 3,851,296 | 11/1974 | Muchmore et al. | 339/60 |
| 3,945,711 | 3/1976 | Hohorst et al. | 439/438 X |
| 3,994,553 | 11/1976 | Kornick | 339/60 |
| 4,534,603 | 8/1985 | Brown et al. | 439/853 X |
| 4,673,232 | 6/1987 | Kubota et al. | 439/441 |

FOREIGN PATENT DOCUMENTS

| | | | |
|---|---|---|---|
| 2130814 | 6/1984 | United Kingdom | 439/853 |

*Primary Examiner*—John D. Lee
*Assistant Examiner*—Phan T. Heartney
*Attorney, Agent, or Firm*—F. J. Fodale

[57] ABSTRACT

A sealed electrical connection comprises a socket connector and an electrical connector plug assembly which includes a plurality of cable termination assemblies. The cable termination assemblies, which include either a conductive elastomeric terminal or a sheet metal terminal in an insulator housing, are put together by arranging an axially projecting bared conductor core end of an ignition cable coaxially with a ferrule portion of the terminal and inserting the axially projecting bared conductor core end of the ignition cable axially into the coaxially arranged ferrule portion of the terminal.

10 Claims, 3 Drawing Sheets

IGNITION CABLE TERMINATION ASSEMBLY AND METHOD OF MAKING SAME

BACKGROUND OF THE INVENTION

This invention relates generally to terminating ignition cable and more specifically to terminating ignition cable having a non-metallic conductive core.

For many years, automotive ignition cable has been manufactured with a non-metallic conductive core to suppress radio frequency interference particularly in the case of high energy ignition systems. These non-metallic conductive cores typically comprise carbon impregnated or coated fiber strands of non-metallic material such as cotton, glass, nylon, and other suitable thermoplastic synthetics.

Such ignition cable is typically terminated in one of two ways. The first way is with a U-shaped staple which has one leg driven axially into the end of the conductive core and the other leg lying adjacent the outside of the insulation jacket at the end of the cable. The ignition cable termination is then completed by simultaneously crimping a ferrule of a sheet metal terminal around the end of the cable and the leg of the U-shaped staple which lies adjacent the end of the ignition cable.

The second and more popular way is to strip away about an inch of the insulation jacket at the end of ignition cable, fold the bared end of the conductive core over the end of the insulation jacket and then simultaneously crimping the ferrule of the sheet metal round end of the insulation jacket and the folded over end of the bared ignition cable.

SUMMARY OF THE INVENTION

The object of this invention is to provide an improved ignition cable termination for ignition cable, particularly ignition cable having a conductive core comprising a non-metallic fiber strand or strands.

A feature of the invention is that the ignition cable is terminated without the need for staples or for folding a bared end of the conductive core over the end of the insulation jacket.

Another feature of the invention is that the ignition cable is terminated without the need for crimping a ferrule of a sheet metal terminal.

Another feature of the invention is that the ignition cable termination provides a cable termination assembly which includes a insulator housing for the terminal which is attached to the cable.

Another feature of the invention is that the insulator housing for the terminal securely fastens the terminal to the ignition cable.

Another feature of the invention is that the ignition cable may be terminated with a conductive elastomeric terminal or a sheet metal terminal which biasingly engage an axially projecting based conductor end of the ignition cable.

Still yet another feature of the invention is that the ignition cable is terminated by arranging an axially projecting bared conductor core end of an ignition cable coaxially with a ferrule portion of a terminal and inserting the axially projecting bared conductor core end of the ignition cable axially into the coaxially arranged ferrule portion of the terminal.

Still yet another feature of this invention is that the ignition cable is terminated by forming an intermediate sub-assembly comprising either the terminal and the cable or the terminal and the insulator housing.

Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of drawing.

DETAILED DESCRIPTION OF THE PREFERRED EMBODIMENT

Figure 1:
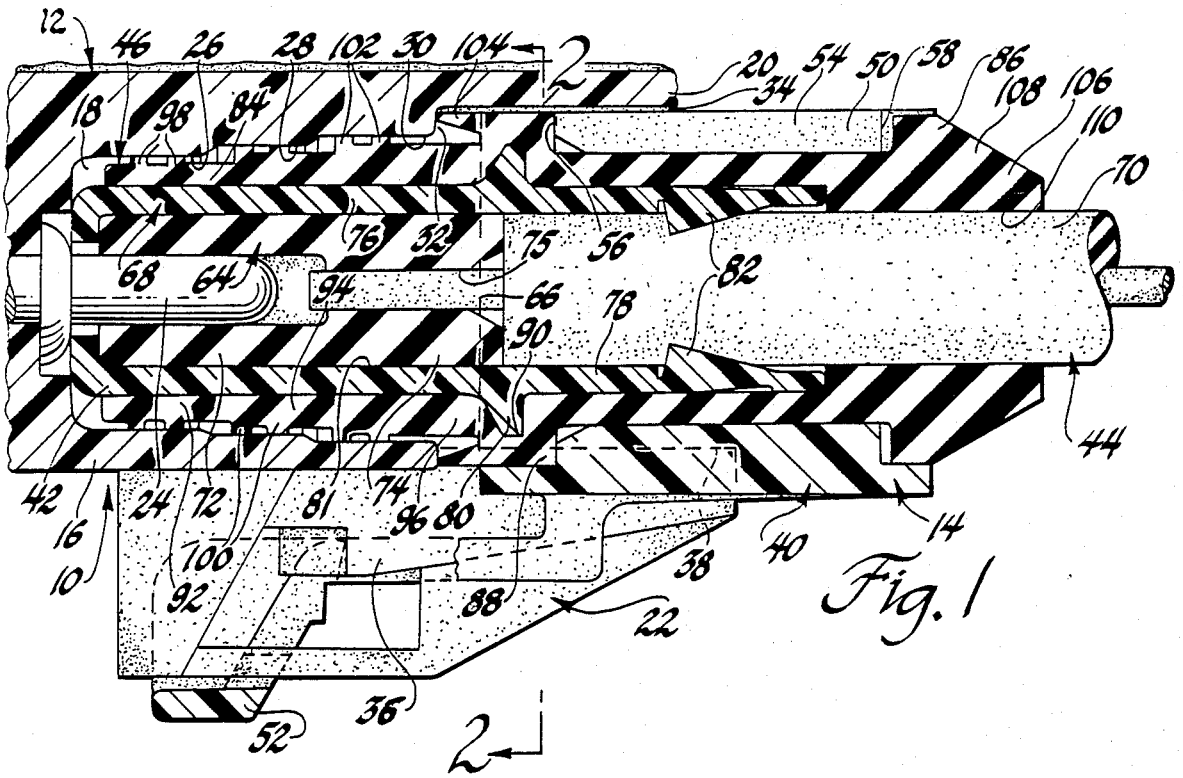
FIG. 1 is a longitudinal sectional view of a sealed electrical connection for an ignition coil comprising an ignition cable termination assembly in accordance with this invention.
Figure 2:
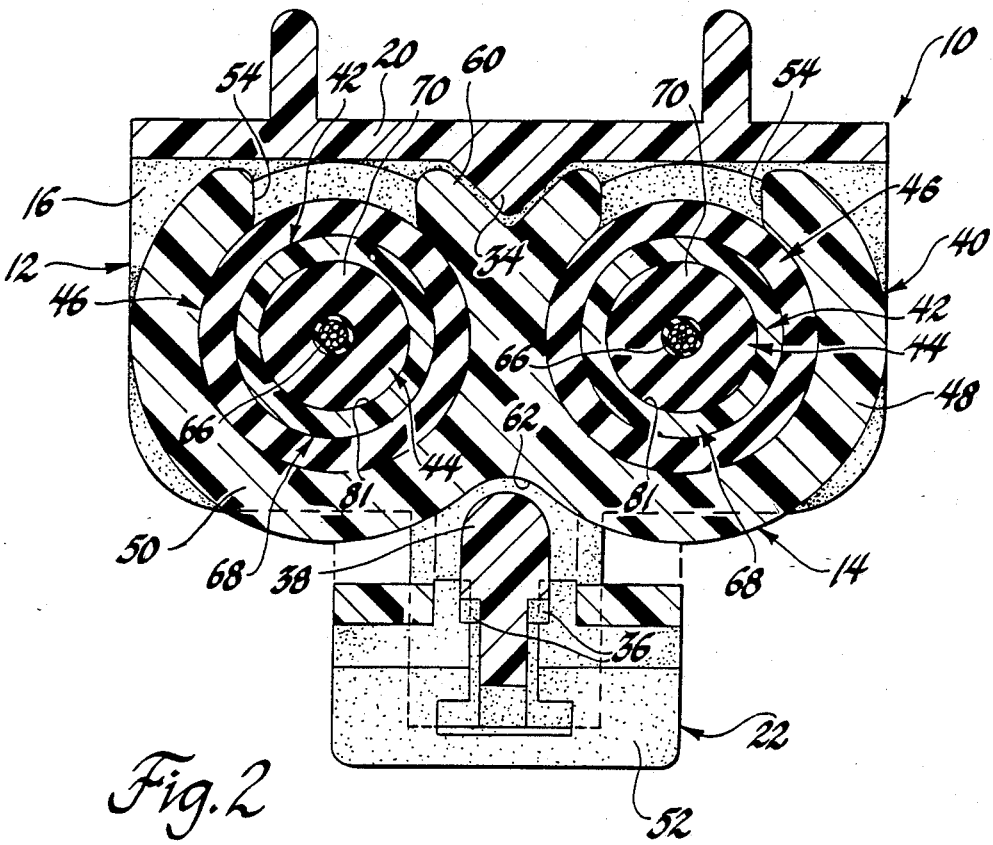
FIG. 2 is a lateral sectional view of the sealed electrical connection which is shown in FIG. 1 taken substantially along the line 2—2 looking in the direction of the arrows.

Referring now to the drawings and more particularly to FIGS. 1 and 2 a sealed electrical connection, which is indicated generally at 10 comprises a socket connector 12 and an electrical connector plug assembly 14.

The socket connector 12, which is incorporated into an ignition coil (not shown), comprises a connector body portion 16 having two laterally spaced cavities 18, an upper planar shelf 20 which projects forwardly of the connector body portion 16 in the longitudinal or axial direction of the cavities 18 and a depending latch member 22 which also projects forwardly of the connector body portion 16 as best shown in FIG. 1.

A pin terminal 24 is centrally located in each of the laterally spaced cavities 18 and projects from the closed end of the cavity. Each of the laterally spaced cavities 18 has a stepped peripheral wall which provides three circumferential sealing surfaces 26, 28 and 30 which progressively increase in diameter toward the open end of the cavity at the end face 32.

The upper planar shelf 20 has a depending, longitudinal, wedge-shaped guide rib 34. The latch member 22 includes a latch nib 36 below the body portion 16 and a rounded guide rib 38 on the projecting portion which is aligned with the guide rib 34 of the shelf 20.

The Electrical Connector Plug Assembly

The electrical connector plug assembly 14 comprises a combined holder-latch member 40, two ignition cable termination assemblies which are attached to the ends of ignition cables or the like such as the ignition cable termination assembly 42 which is attached to the end of the ignition cable 44 and two elastomeric seals such as the elastomeric seal 46.

The holder-latch member 40 comprises two retainer sleeves 48, 50 arranged side-by-side and a deflectable latch arm 52. Each retainer sleeve has a longitudinal assembly slot 54 which extends for the entire length of the retainer sleeve, a forward shoulder 56 and a rearward shoulder 58. The width of the longitudinal assembly slot 54 is large enough so that a sub-assembly comprising the ignition cable termination assembly 42 and the elastomeric seal 46 may be inserted into the associated retainer sleeve 48 or 50. The shoulders 56 and 58 retain the sub-assembly comprising the ignition cable termination assembly 42 and the elastomeric seal 46 in the retainer sleeve. The holder-latch member further comprises aligned upper and lower longitudinal guide grooves 60 and 62 at the juncture of the retainer sleeves 48 and 50. The upper guide groove 60 is V-shaped to match the wedge shaped guide rib 34 and the lower guide groove 62 is rounded to match the rounded guide rib 38.

The Ignition Cable Termination Assembly

The typical ignition cable termination assembly 42 comprises a terminal 64 which is attached to the bared end of the conductive core 66 at the insulation stripped end of the ignition cable 44 and an insulator housing 68 for the terminal 64 which is secured to the insulation jacket 70 of the ignition cable 44 adjacent the bared end as best shown in FIGS. 1 and 2.

The terminal 64 comprises a conductive elastomeric sleeve which has a socket portion 72 at one end for receiving the mating pin terminal 24 and a ferrule portion 74 at the other end for receiving the bared protruding conductive core 66 at the stripped end of the ignition cable 44. The ferrule portion 74 has a larger outer diameter than the socket portion 72 so that the conductive core 66 of the ignition cable 44 is resiliently clamped by the ferrule portion 74 when the terminal 64 is inserted into the insulator housing 68.

The insulator housing 68 comprises a thermoplastic sleeve which has a plug portion 76 at one end, an attachment portion 78 at the other end and a medial flange 80 which is midway between the ends of the thermoplastic sleeve. The attachment portion 78 has a pair of diametrically opposed lock tabs 82 for securing the insulator housing 68 to the insulation jacket 70 of the ignition cable 44 as best shown in FIG. 1. The lock tabs 82 are deformed from an external position shown in FIGS. 3, 4 and 5 to the internal position shown in FIG. 1 where the deformed lock tabs 82 embed in the insulation jacket 70.

The ignition cable termination assembly is put together in the following manner. About an inch of the insulation jacket 70 is stripped away from the conductive core 66 at the end of the ignition cable 70 so that the bared, insulation stripped conductive core end 66 projects axially as shown in FIG. 3.

Figure 3:
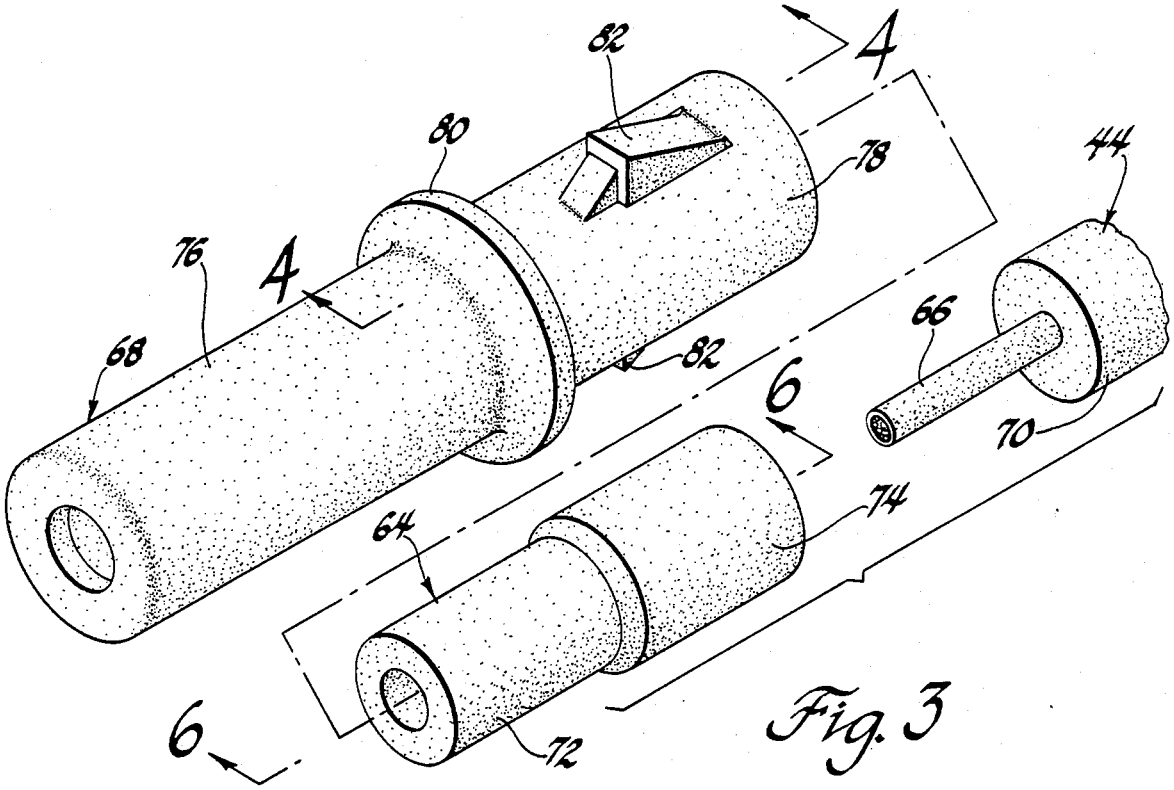
FIG. 3 is an exploded perspective view of the ignition cable termination assembly which is used in the sealed electrical connection which is shown in FIGS. 1 and 2.

The ignition cable 44 and the terminal 64 are then aligned so that the axially projecting, bared conductor core end 66 is arranged coaxially with the ferrule portion 74 of the terminal 64 as shown in FIG. 3. Thus arranged, the axially projecting, bared conductor core end 66 of the ignition cable 44 is then inserted axially into the bore 75 of the coaxially arranged ferrule portion 74 of the terminal 64 to provide a terminal-cable sub-assembly. The bore 75 is preferably slightly oversize to facilitate insertion of the conductor core end 66.

The terminal-cable sub-assembly and the insulator housing sleeve 68 are then aligned so that terminal 64 and adjacent portion of the ignition cable 44 are arranged coaxially with the attachment portion 78 of the insulator housing 68 as indicated in FIG. 3. Thus arranged, terminal 64 and the adjacent portion of the attached ignition cable 44 are then inserted axially into the coaxially arranged attachment portion 78 of the insulator housing 68.

The outer diameter of the socket portion 72 of the terminal 64 is preferably slightly undersize so that the socket portion 72 slips easily into the bore 81 of the insulator housing. However, the outer diameter of the ferrule portion 74 of the terminal 64 is larger than the diameter of the bore 81 by a significant amount. Thus when the ferrule portion 74 of the elastomeric terminal 64 is inserted into the bore 81, the ferrule portion 74 of the elastomeric terminal 64 is squeezed radially inwardly and tightly grips the bared conductor end portion 66 of the ignition cable 44 which is disposed in the bore 75 of the elastomeric terminal 64. This enhances the electrical connection as well as the mechanical friction connection between the elastomeric terminal 64 and the conductor core 66.

Figure 4:
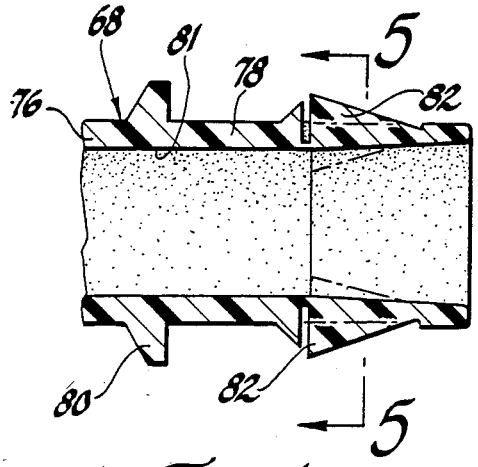
FIG. 4 is a longitudinal sectional view of the insulator housing of the ignition cable termination assembly which is taken substantially along the line 4—4 of FIG. 3 looking in the direction of the arrows.
Figure 5:
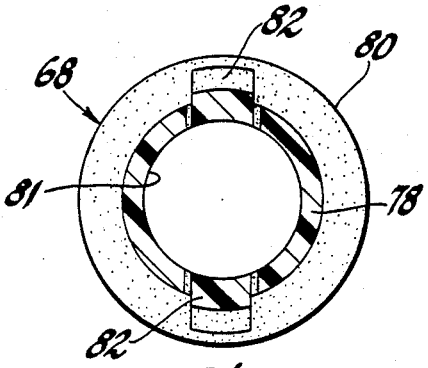
FIG. 5 is a lateral sectional view of the insulator housing taken substantially along the line 5—5 of FIG. 4 looking in the direction of the arrows.
Figure 6:
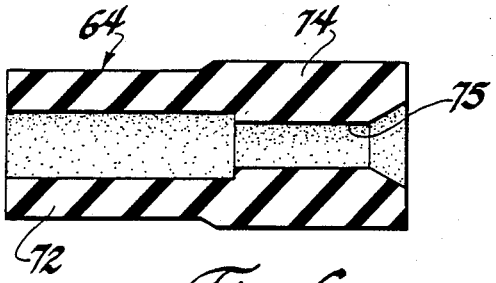
FIG. 6 is a longitudinal sectional view of the terminal of the ignition cable termination which is taken substantially along the line 6—6 of FIG. 3 looking in the direction of the arrows.

When the terminal-cable sub-assembly is fully inserted in the insulator housing 68, the lock tabs 82 are then deformed from an external position shown in FIGS. 3, 4 and 5 to the internal position shown in FIG. 1 where the deformed lock tabs 82 project into the bore 81 and embed in the insulation jacket 70 to securely fasten the insulator housing 68 to the ignition cable 44.

The Elastomeric Seal

The elastomeric seal 46 comprises an elastomeric sleeve which has a connector seal portion 84 at one end, an attachment portion 86 at the other end and a medial flange 88 which has an internal groove 90 which receives the medial flange 80 of the insulator housing 68 when the insulator housing 68 is disposed in the elastomeric seal 46 as shown in FIG. 1.

The connector seal portion 84 of the elastomeric seal 46 comprises three stepped sections 92, 94 and 96 which progressively increase in thickness and outer diameter toward the medial flange 88. The stepped sections have respective pairs of radial lip seals 98, 100 and 102 which also progressively increase in outer diameter. The pairs of lip seals 98, 100 and 102 are matched to the sealing surfaces 26, 28 and 30 so that lip seals 98, 100 and 102 sealingly engage the peripheral wall of the cavity at their respective cooperating sealing surfaces 26, 28 and 30 at the same time. In other words, the pair of lip seals 98 do not engage the sealing surfaces 28 and 30 with any significant force as they pass these surfaces on the way to sealingly engage the sealing surface 26. Similarly, the pair of sealing lips 100 do not engage the sealing surface 30 with any significant force as they pass by on the way to sealing surface 28. This matching the of stepped pairs of sealing lips 98, 100 and 102 to the respective stepped sealing surfaces 26, 28 and 30 reduces the force necessary to connect the electrical connector plug assembly 14 to the socket connector 12 to provide the sealed electrical connection 10.

The medial flange 88 of the elastomeric seal 46 has a longitudinal lip seal 104 which projects toward the connector seal portion 86 and which sealingly engages the end face 32 of the socket connector 12.

The attachment portion 86 of the elastomeric seal 46 has an end flange 106 which has a conical or beveled face 108 at the free end of the attachment portion 86 to facilitate assembly of the elastomeric seal 46 into one of the retainer sleeves of the holder latching member 40. The bore at the free end of the attachment portion has a reduced diameter to provide an internal seal portion 110 for sealing around the insulation jacket 70 of the ignition cable 44.

Assembly of the Electrical Connector Plug Assembly

The electrical plug assembly 14 is assembled in the following manner. Ignition cables having cable termination assemblies, such as the ignition cable termination assembly 42 attached to the end of the ignition cable 44 which is described above, are assembled into elastomeric seals 46 to form a plurality of sub-assemblies each comprising an elastomeric seal 46 fitted onto an termination assembly 42.

During this assembly step, the contact portion 76 of the insulator housing 68 of the ignition termination assembly 42 is inserted through the reduced diameter bore forming the internal seal portion 110 of the elastomeric seal 46 until the medial flange 80 of the insulator housing 68 lodges in the internal radial groove 90 in the medial flange 88 of the elastomeric seal 46 whereupon the ignition termination assembly 42 is retained in the elastomeric seal 46 and the internal seal portion 110 engages the insulation jacket 70 of the ignition cable 44 behind the insulator housing 68 as shown in FIG. 1.

A sub-assembly comprising an elastomeric seal 46 fitted onto a termination assembly 42 is then assembled into each of the retainer sleeves 48, 50 of the holder-latch member 40 into the position shown in FIGS. 1 and 2 where the medial flange 88 and end flange 106 of the elastomeric seal 46 cooperate with the shoulders 56 and 58 of the respective retainer sleeves 48, 50 to retain the respective sub-assembly in the longitudinal direction.

The electrical connector plug assembly 14, comprising the holder-latch member 40, ignition cable termination assemblies 42 and elastomeric seals 46, is plugged into the socket connector 12 with the guide grooves 60 and 62 engaging guide ribs 34 and 38 to guide the connector seal portions 84 of the elastomeric seals 46 and the ignition cable termination assemblies 42 into the cavities 18 of the socket connector 12 so that the sealed electrical connection 10 shown in FIG. 1 is properly made. The electrical plug assembly 14 is latched to the socket assembly 12 by the deflectable latch arm 52 of the holder-latch member 40 which rides over and engages behind the lock nib 36 of the depending latch member 22.

The assembly of the electrical connector plug assembly 14 comprising the holder-latch member 40, ignition cable termination assemblies 42 and elastomeric seals 46 is further described along with further detail of the sealed electrical connection 10 in U.S. Patent Application Ser. No. 117,046 filed by Charles R. Nestor concurrently with this patent application Nov. 5, 1987 and which is hereby incorporated in this patent application by reference.

Alternate Ignition Cable Termination Assembly

Figure 7:
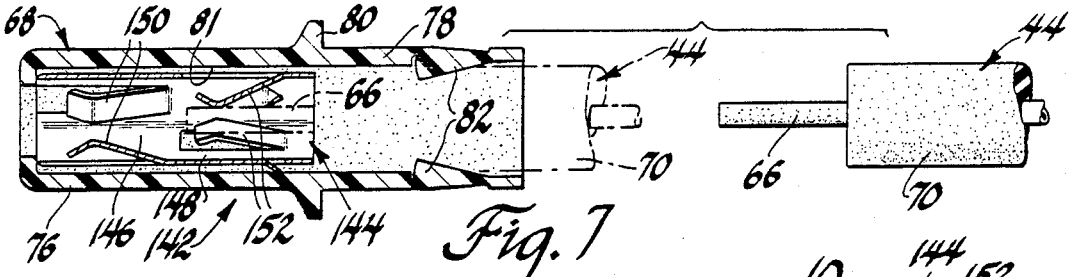
FIG. 7 is a longitudinal sectional view of an alternate ignition cable termination assembly in accordance with the invention.
Figure 8:
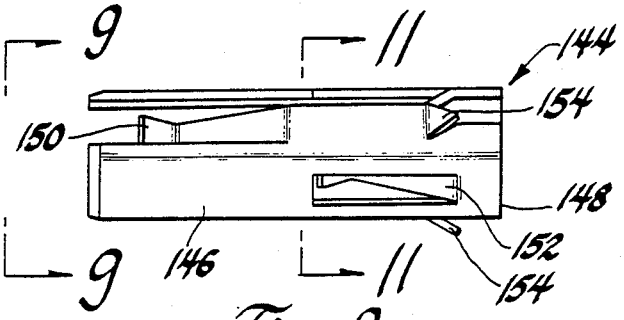
FIG. 8 is a longitudinal view of the alternate terminal of the alternate ignition cable termination assembly which is shown in FIG. 7.

An alternate ignition cable termination assembly 142 is shown in FIGS. 7 through 12. The alternate ignition cable termination assembly 142 comprises a sheet metal terminal 144 which is attached to the bared end of a conductive core 66 at the insulation stripped end of an ignition cable 44 and an insulator housing 68 for the sheet metal terminal 144 which is secured to an insulation jacket 70 of the ignition cable 44 adjacent the bared end as best shown in FIG. 7.

The ignition cable 44 and insulator housing 68 of the alternate ignition cable terminal assembly 142 are identical to those of the ignition cable terminal assembly 42 described above and identical numerals identify the respective parts of these two components. Thus the primary structural distinction of the alternate ignition cable termination assemblies 142 lies in the alternate terminal 144 which is of sheet metal construction.

Figure 12:
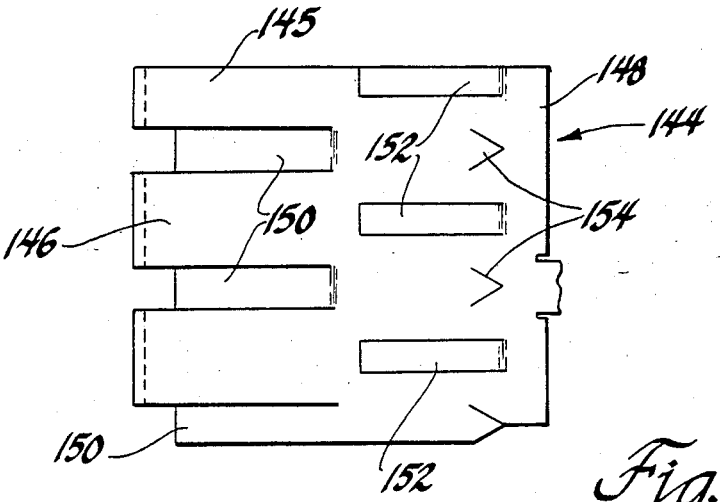
FIG. 12 is a plan view of the blank for making the alternate terminal which is shown in FIGS. 7–11.

The sheet metal terminal 144, which is made from the stamped sheet metal blank 145 shown in FIG. 12, has a generally tubular shape of hexagonal cross section. The tubular sheet metal terminal 144 has a socket portion 146 at one end for receiving the mating pin terminal 24 of the socket connector 12 shown in FIG. 1 and a ferrule portion 148 at the other end for receiving the bared protruding conductive core 66 at the stripped end of the ignition cable 44.

Figure 9:
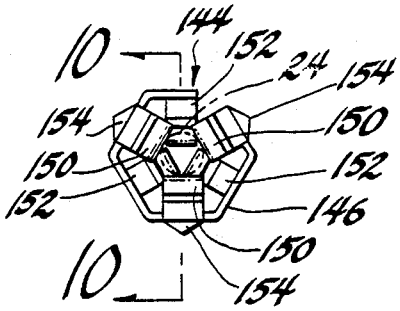
FIG. 9 is a front view of the alternate terminal which is shown in FIG. 8 taken substantially along the line 9—9 of FIG. 8 looking in the direction of the arrows.
Figure 10:
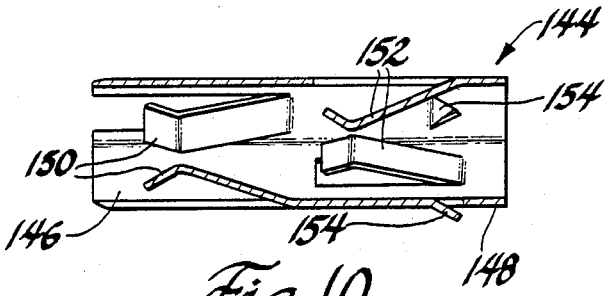
FIG. 10 is a longitudinal sectional view of the alternate terminal taken substantially along the line 10—10 of FIG. 9 looking in the direction of the arrows.

The socket portion 146 has three, circumferentially spaced, spring tongues 150 which project radially inwardly of the socket portion 146 and biasingly engage the pin terminal 24 when it is inserted into the socket portion 146 as indicated in FIG. 9. The three spring tongues 150 are attached to the every other side wall of the hexagonal socket portion 150 at their rearward ends and project forwardly to free ends at the open end of the socket portion 146. The three spring tongues 150 are generally bow-shaped and have convex surfaces toward the axis or centerline of the generally tubular sheet metal terminal 144.

Figure 11:
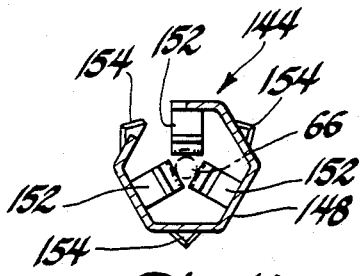
FIG. 11 is a sectional view of the alternate terminal taken substantially along the line 11—11 of FIG. 8 looking in the direction of the arrows.

The ferrule portion 148 also has three, circumferentially spaced, spring tongues 152 which project radially inwardly of the ferrule portion 148 so as to center and biasingly engage the bared, insulation stripped end of the conductive core 66 of the ignition cable 44 when it is inserted into the ferrule portion 148 as indicated in FIG. 11. The spring tongues 152 are also attached to every other side wall of the hexagonal ferrule portion 148 at their respective rearward ends and project forwardly toward the socket portion 146. The three spring tongues 152 are also generally bow-shaped and have convex surfaces toward the axis or centerline of the generally tubular sheet metal terminal 144. The spring tongues 152 are indexed circumferentially with respect to the spring tongues 150, as shown in FIG. 9 by virtue of the fact that the spring tongues 152 are attached to every other side wall which is between the side walls to which the spring tongues 150 are attached a best shown in FIG. 12.

The ferrule portion 148 also has three, circumferentially spaced barbs 154 which project radially outwardly of the ferrule portion 148 to engage the bore of the insulator terminal housing 68 and retain the terminal 144 when the terminal is inserted into the insulator housing 68 as shown in FIG. 7. The barbs 154 are located on the side walls which are between those to which the spring tongues 152 are attached.

The alternate ignition cable termination assembly 142 is put together in the following manner. The sheet metal terminal 144 is loaded into the insulator housing 68 to form a terminal-insulator housing subassembly in which the sheet metal terminal 144 is retained in the insulator housing by the barbs 154 as shown in FIG. 7.

An ignition cable 44 having about an inch of its insulation jacket 70 stripped away from the conductive core 66 at the end of the ignition cable 70 so that the bared, insulation stripped conductive core end 66 projects axially as shown in the right hand side of FIG. 7 is then provided. Such an ignition cable 44 is then aligned with the terminal-insulator housing subassembly as shown in FIG. 7 so that the axially projecting, bared conductor core end 66 is arranged coaxially with the ferrule portion 148 of the terminal 144. Thus arranged, the axially projecting, bared conductor core end 66 of the ignition cable 44 is then inserted axially into the coaxially arranged ferrule portion 148 of the terminal 144 as the cable 44 is fully inserted into the terminal-housing subassembly to the position shown in the left-hand side of FIG. 7 where the end of the insulation jacket 70 engages the end of the sheet metal terminal 144.

When the cable 44 is fully inserted in the terminal-insulator subassembly, the lock tabs 82 are then deformed from an external position shown in FIGS. 3,4 and 5 to the internal position shown in the left hand side of FIG. 7 where the deformed lock tabs 82 project into the bore 81 and embed in the insulation jacket 70 to securely fasten the insulator housing 68 to the ignition cable 44.

The alternate ignition cable termination assembly 142 is interchangeable with the ignition cable termination assembly 42 in the electrical connector plug assembly 14 which is shown in FIGS. 1 and 2.

We wish it to be understood that we do not desire to be limited to the exact details of construction shown and described, for obvious modifications will occur to a person skilled in the art.

The embodiments of the invention in which an exclusive property or privilege is claimed are defined as follows:

1. A cable termination assembly for terminating a cable comprising:

a cable which has an insulation jacket and a conductive core which has a stripped end portion which projects axially of the insulation jacket, an insulator housing which has a plug portion at one end for receiving a terminal and an attachment portion at the other end which secures the insulator housing to the insulation jacket of the cable, and a terminal which is disposed in the insulator housing and which has a socket portion at one end which is disposed in the plug portion of the insulator housing and a ferrule portion at the other end which surrounds and biasingly engages the stripped end portion of the conductive core of the cable.

2. The cable termination assembly as defined in claim 1 wherein the conductive core of the cable comprises non-metallic strand and the terminal is a conductive elastomeric sleeve which has a ferrule portion which is squeezed radially inwardly by the insulator housing so that the stripped end portion of the conductive core is resiliently clamped by the ferrule portion of the elastomeric sleeve.

3. The cable termination assembly as defined in claim 2 wherein the insulator housing has a bore, the socket portion of the elastomeric sleeve has an outer diameter which is slightly undersized to slip freely into the bore and the ferrule portion of the elastomeric sleeve has an outer diameter which is larger than the diameter of the bore by a significant amount so that the ferrule portion of the elastomeric sleeve is squeezed radially inwardly by the insulator housing and resiliently clamps the stripped end portion of the conductive core which is disposed in the ferrule portion of the elastomeric sleeve.

4. The cable termination assembly as defined in claim 1 wherein the conductive core of the cable comprises non-metallic strand and the terminal is a sheet metal terminal of generally tubular shape which has a ferrule portion comprising a plurality of spring fingers which biasingly engage the stripped end portion of the conductive core.

5. The cable termination assembly as defined in claim 4 wherein the sheet metal terminal has barb means for retaining the sheet metal terminal in the insulator housing in the absence of the cable.

6. A method of assembling a cable termination assembly which includes a cable having an axially projecting bared conductor core at an end of the cable, a terminal having ferrule portion for biasingly engaging the axially projecting bared conductor core of the cable, and an insulator housing for the terminal comprising the steps of:

arranging the axially projecting bared conductor core end of a cable coaxially with a ferrule portion of a terminal, and inserting the axially projecting bared conductor core end of the cable axially into the coaxially arranged ferrule portion of the terminal, and securing the insulator housing to the insulation jacket of the cable after the cable, terminal and insulator housing area assembled.

7. The method as defined in claim 6 in which the axially projecting bared conductor core end of the cable is inserted axially into the coaxially arranged ferrule portion of the terminal to form a subassembly which is then inserted into the insulator housing and secured by means of the insulator housing engaging the insulation jacket of the cable.

8. The method as defined in claim 7 wherein the conductor core of the cable comprises non-metallic strand and the terminal is a conductive elastomeric sleeve which has a ferrule portion which is force fit in the elastomeric housing to tightly grip the conductive core of the cable.

9. The method as defined in claim 6 wherein the terminal and insulator housing are assembled to provide a sub-assembly before the the axially projecting bared conductor core end of the cable is inserted axially into the coaxially arranged ferrule portion of the terminal and the insulator housing is secured to the insulation jacket of the cable after the cable is assembled to the sub-assembly comprising the terminal and insulator housing.

10. The method as defined in claim 9 wherein the conductive core of the cable comprises non-metallic strand and the terminal is a sheet metal terminal which has a ferrule portion which includes a plurality of circumferentially arranged spring fingers which biasingly engage the bared conductor core of the cable and further includes a plurality of circumferentially spaced barbs which retain the sheet metal terminal in the insulator housing in the absence of the cable.

* * * * *